United States Patent [19]

Staub

[11] Patent Number: 4,560,159

[45] Date of Patent: Dec. 24, 1985

[54] APPARATUS FOR DETECTING MULTIPLE OCCUPIED POSITIONS IN A CONTINUOUSLY CONVEYED STREAM OF PRINTED PRODUCTS AT UNIFORM SPACING AND METHOD OF USE OF THE APPARATUS

[75] Inventor: Samuel Staub, Hinwil, Switzerland

[73] Assignee: Ferag AG, Hinwil, Switzerland

[21] Appl. No.: 618,670

[22] Filed: Jun. 8, 1984

[30] Foreign Application Priority Data

Jun. 14, 1983 [CH] Switzerland ..... 3260/83

[51] Int. Cl.[4] ..... B65H 7/12

[52] U.S. Cl. ..... 271/263; 192/127; 270/56; 340/674

[58] Field of Search ..... 271/262, 263, 258; 270/56; 192/127, 128, 126; 340/674, 675

[56] References Cited

U.S. PATENT DOCUMENTS 2,712,800 7/1955 Harris ..... 192/127

3,158,369 11/1964 Blenner et al. ..... 271/263

4,021,030 5/1977 Fichte et al. ..... 271/263

*Primary Examiner*—Bruce H. Stoner, Jr.

*Assistant Examiner*—John A. Carroll

*Attorney, Agent, or Firm*—Werner W. Kleeman

[57] ABSTRACT

A sensor element and a counter-element are arranged opposite one another on opposite sides of a stream of printed products or the like. The sensor element is a deflecting feeler element. In order to detect multiple occupied positions and still be able to transport the stream of printed products practically without permanent contact by the sensor element in the absence of multiple occupied positions, the counter-element is intermittently advanced toward the side of the product stream opposite the sensor element at the tempo of the sequential or successive continuously transported printed products. The least distance between the undeflected sensor element and the counter-element in its advanced position corresponds to the thickness of one of the printed products or to an integer multiple thereof. A signal generator is associated with the sensor element and responds to its deflection.

13 Claims, 3 Drawing Figures

APPARATUS FOR DETECTING MULTIPLE OCCUPIED POSITIONS IN A CONTINUOUSLY CONVEYED STREAM OF PRINTED PRODUCTS AT UNIFORM SPACING AND METHOD OF USE OF THE APPARATUS

BACKGROUND OF THE INVENTION

The present invention broadly relates to a detection apparatus for printed products or the like and more specifically, pertains to a new and improved construction of an apparatus for detecting multiple occupied positions in a continuously conveyed flow or stream of printed products arranged at uniform spacing with respect to one another. The present invention also pertains to a method of using such apparatus.

Generally speaking, the apparatus for detecting multiple occupied positions in a sequential or successive flow or stream of products continuously conveyed at uniform spacing comprises a deflectable sensor element oriented substantially toward a first or one side of the stream of printed products, a counter-element oriented substantially toward a second or other side of the stream of printed products and arranged in essentially opposing relation to the sensor element, wherein the second lower side of the stream of printed products is opposite the first upper side thereof.

An apparatus of this type is known, for instance, from the Swiss Pat. No. 523,787, granted June 15, 1972. In this apparatus, the sensor or feeling element is a wheel bearing continuously upon the transported printed products and journalled upon the end of a shaft which is, in turn, pivotable in a direction transverse to its longitudinal extent. The degree of pivoting of this shaft forms a measure of the thickness of the printed products conveyed beneath the wheel. The degree of pivoting of this shaft is, also, only sensed at predetermined times governed by the prescribed or reference sequential rate of flow of the printed products. This known apparatus is therefore in principle able to detect not only a multiple occupied position in the flow or stream of printed products but also an unoccupied position. A principal disadvantage of this known apparatus, however, is that the wheel rolls continuously upon the conveyed printed products and thereby exerts a mechanical pressure thereupon which leaves traces upon the printed products even when the wheel is synchronously driven.

SUMMARY OF THE INVENTION

Therefore, with the foregoing in mind it is a primary object of the present invention to provide a new and improved construction of an apparatus for detecting multiple occupied positions in a continuously conveyed flow or stream of printed products at uniform spacing which does not have associated with it the aforementioned drawbacks and shortcomings of the prior art constructions as well as to provide a new and improved method of using such apparatus.

Another and more specific object of the present invention aims at providing a new and improved construction of an apparatus of the previously mentioned type which allows the flow of printed products to pass so-to-speak "contactless" as long as each position is occupied by only a single copy of the printed product, wherein there is contact only when a certain position in the product flow or stream is occupied by two or more copies of the product.

Yet a further significant object of the present invention aims at providing a new and improved construction of an apparatus of the character described which is relatively simple in construction and design, extremely economical to manufacture, highly reliable in operation, not readily subject to breakdown or malfunction and requires a minimum of maintenance and servicing.

Still a further object of the invention is to provide an improved method of detecting the degree of occupancy of positions of products in a continuous flow or stream of such products arranged essentially at a prescribed constant mutual spacing.

Now in order to implement these and still further objects of the invention, which will become more readily apparent as the description proceeds, the apparatus for detecting multiple occupied positions in a continuously conveyed flow or stream of printed products of the present invention is manifested by the features that the counter-element is intermittently advanced toward the second side of the printed product flow or stream at the frequency of motion of the printed products, the sensor element is arranged in its undeflected state at a distance from the counter-element in its advanced state which corresponds essentially to an integer multiple of the thickness of one of the printed products, and a signal generator or transducer is associated with the sensor element and is sensitive to or responds to deflections of the deflectable sensor element.

The distance may correspond to an integer multiple of the thickness of a printed product in which the integer is one or a number greater than one.

The use of the apparatus according to the invention is manifested by the features that it is employed in an insertion apparatus in which a printed product supplement is inserted into a principal or parent printed product, the principal or parent printed products are delivered to the insertion apparatus in a continuous flow or stream by means of a conveyor, the insertion device is associated with the conveyor, and the signal generator or transducer controls an erroneous copy discharge means.

Since the distance or spacing between the counter-element in its advanced position and the undeflected sensor or feeler element essentially corresponds to the thickness of a single printed product or to an integer multiple of such thickness, the sensor or feeler element is not deflected as long as only one copy of the printed product occupies each prescribed position in the flow or stream of printed products.

The flow or stream of printed products can also comprise a "crowded" or dense imbricated product flow or stream in which the distance or spacing between subsequent printed products is relatively small, so that (as long as the prescribed positions of the imbricated flow are occupied only by single copies of the printed product) the thickness of the product flow or stream corresponds to a constant integer multiple of the thickness of a single copy of the printed product. If a position in such a product stream or flow is, for example, doubly, then the total thickness of the imbricated product flow or stream increases by the thickness of the excessive copy of the printed product.

The apparatus is, however, preferably employed in connection with a "loose" imbricated flow or stream of printed products in which only the leading and trailing edges of each copy of the printed product overlap the adjacent edges of the preceding and subsequent printed product. The apparatus is, of course, also utilizable for individually transported printed products.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
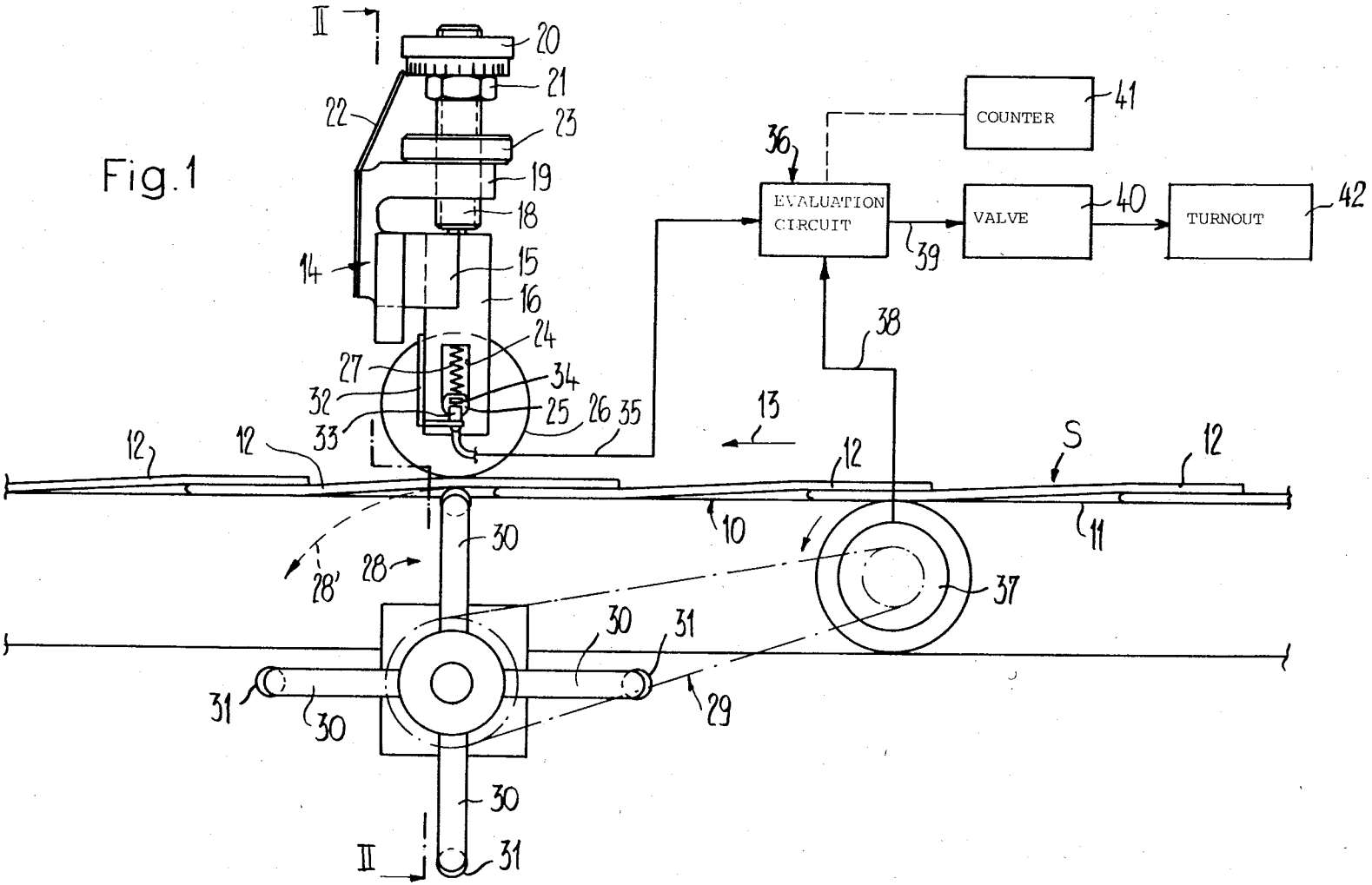
FIG. 1 shows a schematic side view of the apparatus according to the invention.

Describing now the drawings, it is to be understood that to simplify the showing of the drawings only enough of the structure of the apparatus for detecting multiple occupied positions in a continuously conveyed flow or stream of printed products or the like has been illustrated therein as is needed to enable one skilled in the art to readily understand the underlying principles and concepts of this invention. The illustrated exemplary embodiment of the apparatus will be seen to comprise a conveyor 10 which, for the sake of simplicity, is illustrated here as a conveyor belt 11 and which transports or conveys a loose imbricated flow or stream S of individual printed products 12 in the direction of the arrow 13. It will be seen in FIG. 2 that the width of the conveyor belt 11 is sized such that the printed products 12 extend beyond one lateral edge of the conveyor belt 11. It will, on the other hand, be seen from FIG. 1 that the imbricated product flow or stream S is loose in the sense that each printed product 12 overlaps the preceding and the subsequent printed product 12 only in the region of its leading and trailing edges while both the underside and the upper side of the printed product lying therebetween are freely exposed.

A bearing block or housing 16 is guided in guide members 15 upon a cantilever member or arm 14 stationarily mounted in relation to the conveyor 10 and such bearing block or housing 16 is translatable in a direction extending substantially at right angles to the plane of the printed products 12. One end of a micrometer screw 18 formed similar to a rivet engages the upper end of the bearing block or housing 16. The external threads of the micrometer screw 18 are threaded into a threaded bore in a portion 19 of the cantilever arm 14 protruding laterally therefrom. A graduated dial or scale 20 is mounted at the upper end of the micrometer screw 18 and is secured against rotation in relation to the micrometer screw 18 by a locknut 21 or equivalent structure. A pointer 22 fastened to the cantilever arm 14 is associated with the graduated dial 20. A further locknut 23 or equivalent structure threaded upon the micrometer screw 18 and tightened against the portion 19 of the cantilever arm 14 secures the micrometer screw 18 against rotation and therefore secures the bearing block or housing 16 in an initially adjusted position or height.

The lower portion of the bearing block or housing 16 is fork-shaped. A slot or longitudinal aperture 24 is formed in each leg of the fork. A non-rotating shaft or axle 25 of a rotatable feeler or sensor wheel 26 arranged between the legs of the fork is translatably journalled in these slots or longitudinal apertures 24. A compression spring 27 is also arranged in each slot or longitudinal aperture 24 and tends to press the shaft or axle 25 toward the lower end of the related slot or longitudinal aperture 24 as represented in the Figures. The feeler wheel 26 is therefore deflectable out of the illustrated idle position or undepleated state against the action of the springs 27 and away from the imbricated product flow or stream S. In the exemplary embodiment the feeler wheel 26 with its shaft or axle 25 therefore form or define the sensor or feeler element of the invention.

Figure 2:
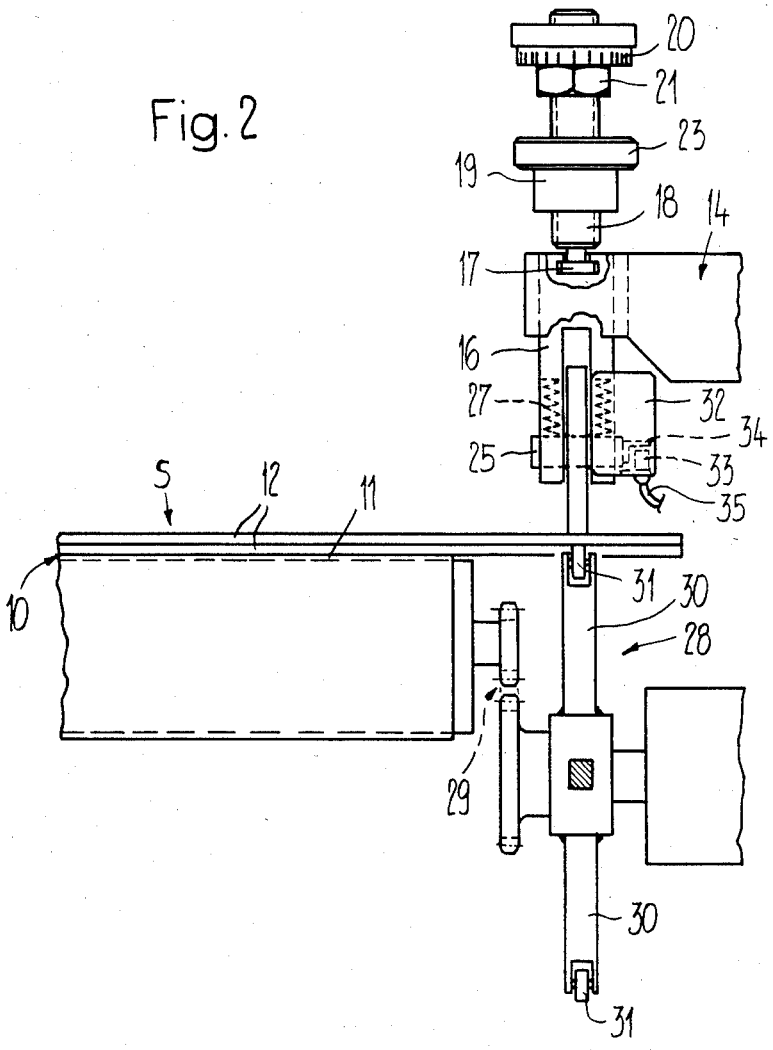
FIG. 2 shows a front view taken in partial section along the line II—II of FIG. 1.

A radial-arm or star rotor 28 is arranged on the side of the imbricated product flow or stream S opposite the feeler wheel 26 and is driven in rotation by a chain drive 29 or other suitable drive rigidly coupled to the standard drive of the conveyor 10 in synchronism with and in the same direction as the conveyor 10, i.e. this rotor 28 is driven in the direction of the arrow 28' in FIG. 1. The radial-arm rotor 28 has a period of rotation and a plurality of equal length arms or spokes 30 (in the illustrated embodiment four such arms or spokes) whose free ends are provided with rotatable rollers 31.

The number of arms 30 or, in other words, their angular spacing and the drive ratio of the chain drive 29 are chosen such that the free end of an arm 30 with its roller 31 is situated opposite the feeler or sensing wheel 26 only when the region of a printed product 12 not overlapping and not being overlapped by another printed product 12 passes beneath the feeler wheel 26. One could also say that the individual arms 30 of the radial-arm rotor 28 (which forms the counter-element to the sensor or feeler element) instantaneously raises this non-overlapped and non-unoverlapping region of each printed product toward or against the feeler wheel 26 defining the sensing or feeler element.

In the illustrated embodiment, the adjustment of the micrometer screw 18 and with it the elevational position of the undeflected feeler wheel 26 is set such that the distance of the circumference of the feeler wheel 26 from the circumference of the roller 31 at the end of that radial arm 30 which is currently opposite the feeler wheel 26, i.e. which is currently advanced against the lower side of the imbricated product flow or stream S, essentially corresponds to the thickness of a printed product 12 or to a thickness only fractions of a millimeter greater. The feeler wheel 26 therefore remains undeflected as long as only a single printed product 12 is present in the position in the imbricated product flow or stream S being sensed.

In order to detect the deflections of the feeler wheel 26, the following elements are provided in the illustrated embodiment and are representative of many conceivable possibilities. A proximity switch 33 is fastened to the bearing block or housing 16 by means of a mounting bracket 32, preferably in a fixed location. The proximity switch 33 cooperates with an armature 34 fastened to the free end of the shaft 25. The proximity switch 33 changes its state of opening or closure as soon as the armature 34 recedes from the proximity switch 33 by a predetermined amount.

Figure 3:
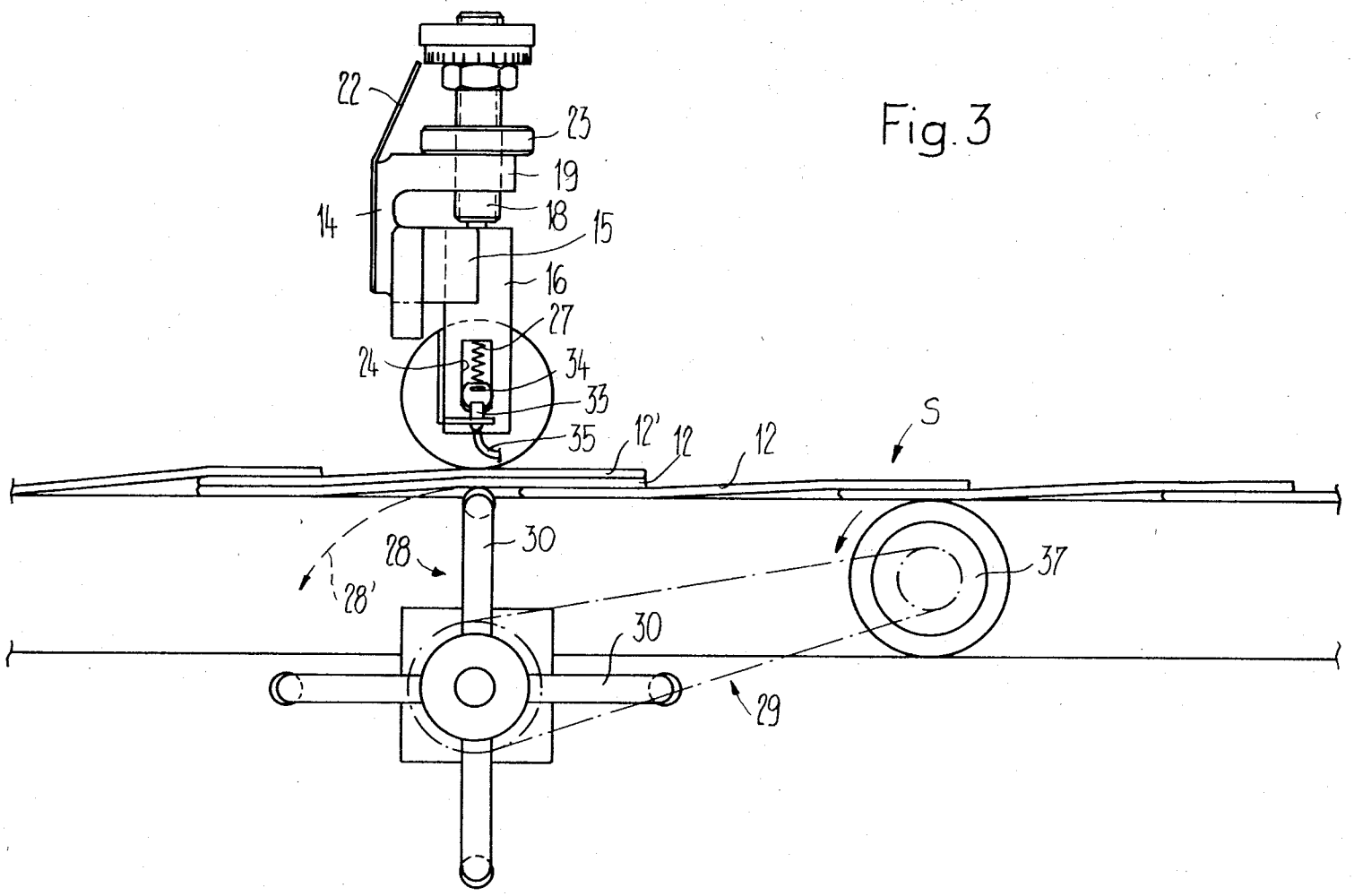
FIG. 3 shows a side view analogous to FIG. 1 during the passage of a doubly occupied position.

This is shown in FIG. 3 in which the feeler wheel 26 is lifted out of its idle or rest position (as shown in FIG. 1) by an excess printed product 12'. The armature 34 is thereby appreciably removed from the proximity switch 33, which then generates a suitable output signal.

This signal is conveyed through a conductor 35 to an evaluation circuit 36 which may comprise, for instance, a shift register or a delay circuit.

Advantageously, a signal generated by a tacho-generator 37 indicative of the conveying speed of the conveyor 10 is also conducted via a conductor 38 to the evaluation circuit 36. The evaluation circuit 36 controls, in turn, for instance, a valve 40 which operates a turnout or deflecting switch of an erroneous copy discharge conveyor 42 arranged further downstream. On the other hand, the evaluation circuit 36 can also be connected to a counter 41, for instance, which counts how often the proximity switch 33 has responded and thereby gives the operating personnel an indication that adjustment work on the conveyor 10 or on the apparatus is necessary.

As initially mentioned, the apparatus described can also be used with thicker imbricated product flows or streams, since whenever a position in such product stream is doubly or multiple occupied the total thickness of the product stream increases by the thickness of the number of excess printed products present at this position. The apparatus described can also be employed when the printed products are transported by a conveyor equipped with grippers or clamps. It is then advantageous to orient the sensor or feeler element toward the product flow from below and the counter-element from above.

While there are shown and described present preferred embodiments of the invention, it is to be distinctly understood that the invention is not limited thereto, but may be otherwise variously embodied and practiced within the scope of the following claims.

What I claim is:

1. An apparatus for detecting multiple occupied positions in a continuously conveyed stream of sequential printed products arranged at a substantially uniform spacing from one another, comprising:

a deflectable sensor element oriented substantially toward a first side of the stream of printed products;

a counter-element oriented substantially toward a second opposite side of the stream of printed products and arranged in essentially opposing relationship to said sensor element;

means for advancing said counter-element towards the second opposite side of the stream of printed products at a frequency corresponding to a predetermined frequency of passage of the stream of printed products;

the deflectable sensor element being arranged in an undeflected state thereof at a distance from the counter-element in an advanced state thereof corresponding essentially to an integer multiple of the thickness of a printed product; and a signal generator responding to deflections of the deflectable sensor element operatively associated with said deflectable sensor element.

2. The apparatus as defined in claim 1, wherein:

said integer multiple is one.

3. The apparatus as defined in claim 1, wherein: said integer multiple is a whole number greater than one.

4. The apparatus as defined in claim 1, wherein:

said counter-element comprises a radial-arm rotor;

said radial-arm rotor having a plurality of equal-length arms and a period of rotation;

each of said plurality of equal-length arms having a free end; and said period of rotation being adapted to a predetermined speed of conveying of said stream of printed products and to said uniform spacing of the stream of printed products such that a respective one of said free ends is situated opposite said deflectable sensor element each time a printed product passes by the deflectable sensor element.

5. The apparatus as defined in claim 4, wherein:

said free ends of said equal-length arms are provided with freely rotatable rollers.

6. The apparatus as defined in claim 4, wherein:

said stream of said printed products has a predetermined travel direction;

said radial-arm rotor having a predetermined direction of rotation; and said predetermined direction of rotation and said predetermined travel direction being of the same sense.

7. The apparatus as defined in claim 6, wherein:

said deflectable sensor element comprises a feeler wheel oriented substantially towards said stream of printed products;

spring means for acting upon said feeler wheel; and said feeler wheel having an undeflected state and being deflectable out of said undeflected state in a direction substantially away from the stream of printed products and against the action of said spring means.

8. The apparatus as defined in claim 1, further including:

an evaluation circuit;

said signal generator comprising a proximity switch sensitive to a deflection of said deflectable sensor element; and said proximity switch being coupled to said evaluation circuit.

9. The apparatus as defined in claim 7, further including:

a shaft resiliently displaceable in a direction substantially transverse to a predetermined transport plane along which there is conveyed the stream of printed products;

said feeler wheel being journalled upon said shaft;

said signal generator comprising a fixed-location proximity switch; and an armature mounted on said shaft and cooperating with said proximity switch.

10. The apparatus as defined in claim 1, further including:

means for mutually adjusting and fixing the position of said counter-element and said deflectable sensor element in relation to one another.

11. The apparatus as defined in claim 10, wherein:

said mutually adjusting means comprises a threaded spindle for adjusting said deflectable sensor element in relation to said counter-element.

12. A method for detecting the degree of occupancy of positions in a stream of continuously conveyed printed products, comprising the steps of:

conveying said continuous stream of printed products by means of a conveyor to a detection device comprising a deflectable feeler wheel defining a sensing device and a multiple-arm rotor defining a counter-element;

driving said multiple arm rotor to rotate in the same direction as said conveyor and in synchronism with said conveyed printed products such that an arm thereof is situated directly opposite said deflectable feeler wheel when an exposed region of each printed product is conveyed past the deflectable feeler wheel;

sensing deflections of the deflectable feeler wheel to generate a signal; and evaluating said signal to detect deviations from an integer multiple of the thickness of a printed product.

13. The method as defined in claim 12, comprising the further steps of:

mounting said multiply-arm rotor and said feeler wheel subsequent to an insertion device in which at least one printed product supplement is inserted into a principal printed product; and using said signal to control an erroneous copy discharge conveyor arranged subsequent to said feeler wheel.

* * * * *

UNITED STATES PATENT AND TRADEMARK OFFICE

CERTIFICATE OF CORRECTION

PATENT NO. : 4,560,159
DATED : December 24, 1985
INVENTOR(S) : SAMUEL STAUB

It is certified that error appears in the above—identified patent and that said Letters Patent is hereby corrected as shown below:

Column 2, line 60, after "doubly" insert --occupied--

Column 4, line 10, delete "undepleated" and insert --undeflected--

Column 8, line 3, delete "multiply-arm" and insert --multiple-arm--

Signed and Sealed this

*Twenty-fifth* Day of *March 1986*

[SEAL]

*Attest:*

DONALD J. QUIGG

*Attesting Officer*

*Commissioner of Patents and Trademarks*